US007172679B2

(12) United States Patent
Gustavsson et al.

(10) Patent No.: US 7,172,679 B2
(45) Date of Patent: Feb. 6, 2007

(54) PRESS DEVICE HAVING AN EXTENDED PRESS NIP FOR PRESSING OF A TRAVELLING PAPERBOARD WEB, AND PROCEDURE FOR CONTROLLING THE PRESSURE CURVE IN THE MACHINE DIRECTION BY SUCH PRESS NIP

(75) Inventors: Lars Gustavsson, Karlstad (SE); Erik Brox, Forshaga (SE)

(73) Assignee: Metso Paper, Inc., Helsinki (FI)

( * ) Notice: Subject to any disclaimer, the term of this patent is extended or adjusted under 35 U.S.C. 154(b) by 1507 days.

(21) Appl. No.: 09/734,310

(22) Filed: Dec. 11, 2000

(65) Prior Publication Data

US 2006/0144545 A1 Jul. 6, 2006

Related U.S. Application Data

(60) Provisional application No. 60/172,534, filed on Dec. 17, 1999.

(30) Foreign Application Priority Data

Dec. 10, 1999 (SE) ..... 9904544

(51) Int. Cl.
*D21F 3/02* (2006.01)

(52) U.S. Cl. ..... 162/205; 162/358.3; 100/153

(58) Field of Classification Search ..... 162/204–207, 162/358.1, 358.3, 358.4; 100/118, 153, 121, 100/38

See application file for complete search history.

(56) References Cited

U.S. PATENT DOCUMENTS 4,705,602 A * 11/1987 Dahl ..... 162/358.3
4,713,147 A 12/1987 Saarinen
4,917,768 A * 4/1990 Ilmarinen ..... 162/358.3
4,973,384 A * 11/1990 Crouse et al. ..... 162/358.5
5,650,047 A * 7/1997 Meschenmoser ..... 162/358.3
5,676,799 A * 10/1997 Meschenmoser et al. 162/358.3
5,753,084 A * 5/1998 Bubik et al. ..... 162/358.3
5,925,219 A * 7/1999 Schiel ..... 162/205
5,997,696 A 12/1999 Gustavsson et al.
6,030,502 A * 2/2000 Meschenmoser ..... 162/358.3
6,042,694 A * 3/2000 Brox ..... 162/358.3
6,083,352 A * 7/2000 Snellman et al. ..... 162/358.3

OTHER PUBLICATIONS

PCT International-Type Search Report, Swedish National Application No. 9904544-5, completed on Aug. 23, 2000.

* cited by examiner

*Primary Examiner*—Eric Hug
(74) *Attorney, Agent, or Firm*—Alston & Bird LLP

(57) ABSTRACT

A press device with an extended press nip for pressing of a continuous paper or paperboard web comprises a press shoe, a backing member, a support, and a plurality of loading cylinders with main axes in their longitudinal directions. The press shoe can be moved between different positions. A stop member is arranged downstream of the press shoe for transfer between and fixation at different stop positions in the machine direction. At least some of the loading cylinders or the support comprise members eccentrically arranged with respect to one or some of the main axes, which members can be brought into different eccentric positions with respect to the main axes. The eccentric position and the stop position controls the position of the press shoe during the pressing, and thereby the pressure curve.

13 Claims, 2 Drawing Sheets

PRESS DEVICE HAVING AN EXTENDED PRESS NIP FOR PRESSING OF A TRAVELLING PAPERBOARD WEB, AND PROCEDURE FOR CONTROLLING THE PRESSURE CURVE IN THE MACHINE DIRECTION BY SUCH PRESS NIP

CROSS-REFERENCE TO RELATED APPLICATION

The present application claims the benefit of U.S. Provisional Patent Application No. 60/172,534, filed Dec. 17, 1999.

FIELD OF THE INVENTION

The present invention relates to a press device having an extended nip intended for pressing a running paper or paperboard web. The invention further relates to a procedure for controlling the pressure curve in the machine direction by such a press nip. More specifically, the invention relates to a shoe press of the type which comprises a support which supports a press shoe adjacent to a counter roll or another backing member in such a way that the press shoe and the backing member form an extended nip between themselves, and which furthermore comprises a hydraulic or pneumatic arrangement for urging the press shoe towards the backing member in order to apply a pressure onto the web passing through the nip.

The press device and procedure according to the invention can particularly advantageously be utilised for wet-pressing of moist paper or paperboard webs, but also for calendering or other finishing of dried paper or paperboard. It may also be contemplated that the pressing device according to the invention and the procedure is utilized for other fibre webs than paper and paperboard.

BACKGROUND OF THE INVENTION

For a long time, shoe press devices, i.e. presses having an extended nip, have been employed when manufacturing different paper and paperboard grades, primarily for wet-pressing in order to increase the dryness of the web, but also for calendering and other finishing in order to improve surface properties or other physical properties of the web.

As a result of their longer nips, shoe press devices provide a number of advantages in comparison to conventional roll presses, such as higher dryness at the same nip pressure, or a pressing at a lower nip pressure but with maintained dryness which is more gentle to the sheet.

In order to regulate the press nip conditions in a shoe press, such as the pressure curve in the machine direction throughout the nip, it is often desirable to be able to displace the pressure shoe forward or backward in the machine direction, to thereby affect the pressure curve through the press nip in such a way that the press power is at its highest in the beginning and lower towards the end of the press nip, or vice versa. At such regulation the pressure shoe will, in principle, follow an arc-shaped line of movement centred in the central axis of the counter roll.

The reason for the desirability of a regulated pressure curve in the machine direction throughout the press nip is, among others, that different qualities of paper or paperboard have different optimal pressure curves.

U.S. Pat. No. 4,713,147 describes a shoe press with an extended press nip in a paper machine, in order to remove water from a wet fibrous and porous paper or paperboard web. The press comprises a rotating press roll and at least one loading shoe, which is pressed towards the press roll to form a prolonged pressing zone. The loading shoe is capable of rotating around an axis parallel to the axis of the press roll. The web to be dewatered is passed through the pressing zone together with at least one felt that receives water from the web. The loading shoe is supported on a carrier frame by supporting means. The center of gravity of the supporting force exerted by the supporting means at the shoe is displaceable in the dewatering direction of the web in order to allow adjustment of the pressure pattern generated in the pressing zone when different paper qualities are processed. The displacement of the center of gravity is performed either mechanically, by displacing the supporting means in relation to the shoe, or hydraulically, by varying the pressures in two separate pressure cushions in the supporting means.

Further, SE-C2-510 609 describes a shoe press for a paper or paperboard machine comprising a pressing shoe and a counter roll, between which is formed an extended nip for a paper or paperboard web, and a circulated flexible belt. The shoe press further comprises at least one press cylinder arranged between a horizontal beam and the press shoe, in order to press the latter against the counter roll. The press shoe is arranged on top of the press cylinder, whereby there is a device for anchoring the press cylinder to the horizontal beam, which can be disconnected. After the disconnection of the anchoring device, the press cylinder may be affected by eccentric members for displacement in the machine direction, and for the regulation of the pressure profile of the shoe press.

In the publication EP 0 933 471, corresponding to U.S. Pat. No. 6,083,352, the disclosure of which is incorporated herein by reference, a shoe press is disclosed which reduces the problems originating from the thermal expansion of the press shoe, since it has the ability to tolerate relatively large elongations of the press shoe across the machine direction, and also other deformations of the press shoe. The disclosed shoe press comprises a press shoe extending in the cross-direction along the entire width of a web running through the press, and a plurality of articulated hydraulic loading cylinders supported by a support and spaced apart along the shoe. The loading cylinders define working chambers which can be pressurised by hydraulic fluid, so as to enable the cylinders to force the press shoe away from the support and towards a counter roll or other backing member for applying pressure to the web being carried through the nip defined between the shoe and the backing member. Each loading cylinder comprises a piston member disposed within a cylinder member. Either the piston or the cylinder comprises a two-part member having a first member fixed relative the press shoe and a second member fixed relative to the support, while the remaining piston or cylinder comprises a coupler. Since the press shoe of the shoe press disclosed in EP 0 933 471 also can be moved or tilted in the machine direction in relation to the support, the shoe press comprises a stop member restricting the movement of the shoe forward in the machine direction.

Further, the applicants' own Swedish, still unpublished patent application SE 9901636-2 describes a shoe press for a paper or a paperboard machine. The shoe press comprises a press shoe and a counter roll, which between themselves form an extended nip for passage of a paper or paperboard web and an endless flexible belt therethrough, and at least one press cylinder arranged between a horizontal beam included in the support system of the shoe press and the press shoe, for pressing the press shoe against the counter roll. The cylinder or piston of the press cylinder is mounted in bearings to swivel around an axis in relation to which the axis forming a symmetry axis for the work space of the press cylinder is eccentric. The shoe press further possesses maneuvering members for swivelling of the cylinder or piston of the press cylinder in order to regulate the pressure profile of the shoe press, which maneuvering members comprise an actuating device extending outside the mantle.

In U.S. Pat. No. 5,676,799 a device is described, with an extended press nip for treatment of a fiber web. At the device at least one press surface is formed by a belt subjected to pressure from at least one cylinder-piston unit by way of a hydraulic contact pressure device, consisting of at least one supporting element, whereby a supply of pressurised fluid for pressure pockets of the supporting element is insured by one of the parts of the piston-cylinder unit being permanently connected to a part of the supporting element, whereas the other part of the piston-cylinder unit is kept movable in the machine direction and in the direction of web displacement on one of the elements, and whereby the supporting element is supported by way of a stop attached to the supporting part.

Many of the previously known arrangements for affecting the pressure curve in the machine direction of extended press nips may be experienced as unnecessarily complicated and expensive, and often require an appreciable amount of time to make the adjustments necessary when switching from one pressure curve to another.

Further, there is a frequent risk that the desired adjustment of the pressure curve in the machine direction is disturbed during operation, which may lead to problems concerning operability and quality.

SUMMARY OF THE INVENTION

Accordingly, the first object of the present invention is to provide a press device having an extended nip for pressing a running paper or paperboard web that allows adjustments between different pressure curves in a simple, cheap and reliable manner.

This first object of the present invention is achieved, in accordance with one preferred embodiment of the invention, by a press device comprising a press shoe directed across the machine direction, arranged in order to form an extended nip in cooperation with a backing member for passage of the web during pressing, and a support that supports the press shoe in a manner displaceable towards the backing member by way of several loading cylinders arranged along the press shoe in order to make possible the application of pressure to the web during pressing. At least some of the loading cylinders comprise a first end intended to be fixed to the press shoe and a second end intended to be fixed to the support, whereby each of the loading cylinders have a main axis in their longitudinal direction. The press shoe is arranged for displacement between different positions in relation to the support and the backing member for controlling a pressure curve in the machine direction throughout the press nip, whereby a stop member is arranged downstream of the press shoe.

According to the invention the stop member is thereby arranged for displacement between, and fixation at, different stop positions in the machine direction, whereby at least some of the loading cylinders or the support comprise members, eccentrically arranged relative to one or some of the main axes, that can be brought into various eccentric positions relative to the main axes, in such a way that the present eccentric position and the present stop position controls the position of the press shoe during the pressing, and thereby the pressure curve in the machine direction throughout the press nip.

A second object of the invention is to provide a procedure for controlling the pressure curve in the machine direction throughout the press nip in the press device according to the invention. This second object of the present invention is reached, in accordance with a preferred embodiment of the invention, by a procedure, in which the press nip is provided by a press device according to the invention, comprising a press shoe, a backing member, a support, and several loading cylinders, at least some of which comprise a first end intended to be fixed to the pressure shoe, and a second end intended to be fixed to the support, each of the loading cylinders having a main axis in its longitudinal direction. The press shoe can be displaced between different positions in relation to the support and the backing member in order to control the pressure curve, whereby a stop member is provided downstream of the press shoe.

According to the invention the pressure curve in the machine direction is controlled by the extended press nip by displacement of members, eccentrically arranged in relation to one or more of the main axes, of the support or the loading cylinders, from a first eccentric position to a second eccentric position in relation to the main axes, while the stop member is transferred from a first stop position to a second stop position, in such a way that the second eccentric position and the second stop position causes the position of the press shoe to change from a first position to a second position in relation to the support and the backing member.

Further objects of the present invention will be apparent from the following description, while the characteristics that realise the achievement of the further objects are stated in the appended claims.

BRIEF DESCRIPTION OF THE DRAWINGS

In the following, the invention will be described in greater detail with reference to the drawings, in which.

DETAILED DESCRIPTION OF PREFERRED EMBODIMENTS

Figure 1A:
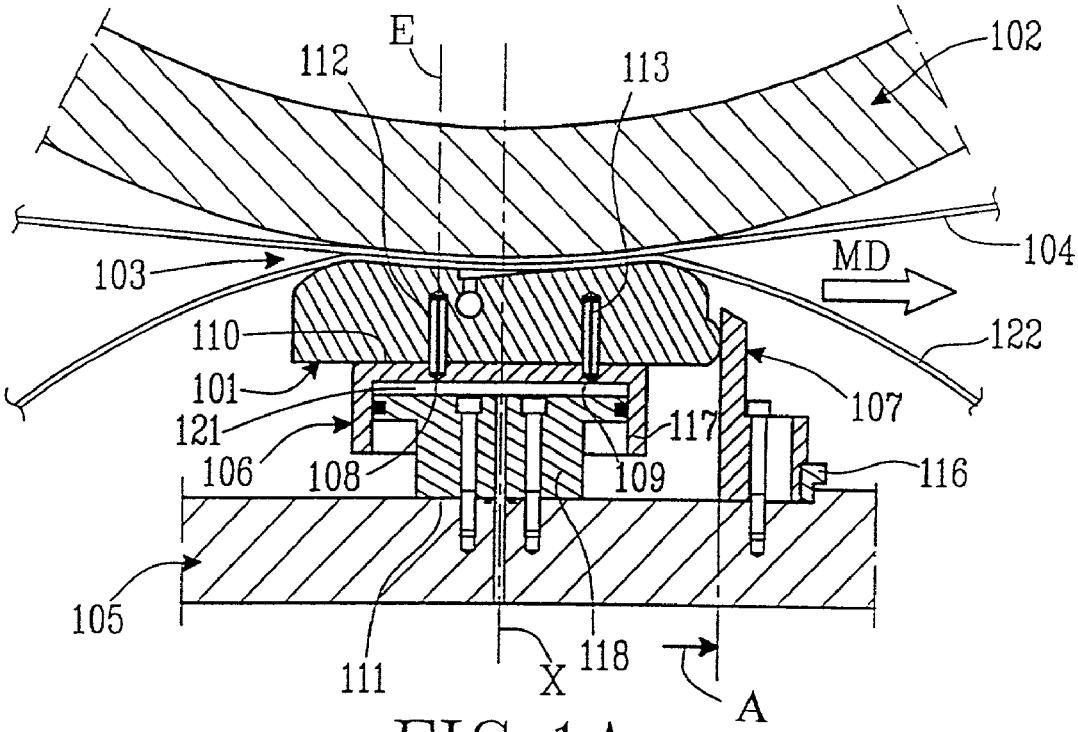
FIG. 1*a* shows a schematic sectional view seen across the machine direction of a shoe press device according to a preferred embodiment of the invention, with its press shoe in a first position.
Figure 1B:
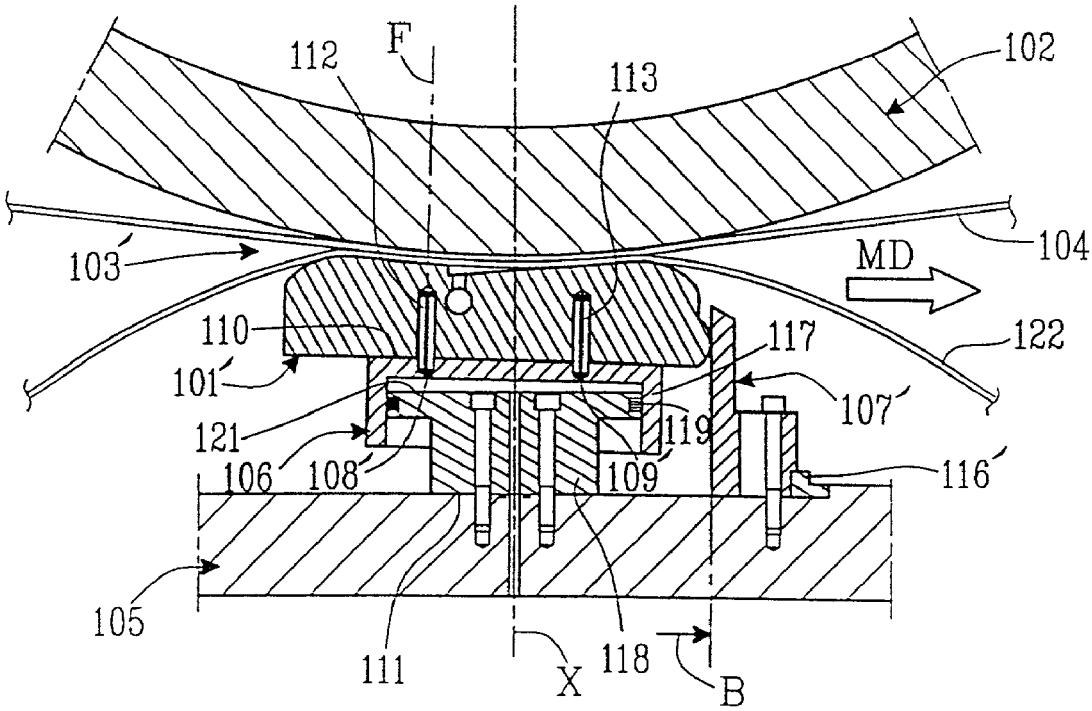
FIG. 1*b* shows a schematic sectional view across the machine direction of the shoe press device of FIG. 1*a*, but this time with its press shoe in a second position.

In the attached FIGS. 1*a* and 1*b* is shown a schematic sectional view of a shoe press device according to a preferred embodiment of the invention, in FIG. 1*a* with its press shoe 101 in a first position, and in FIG. 1*b* with the press shoe 101' in a second position.

Figure 2A:
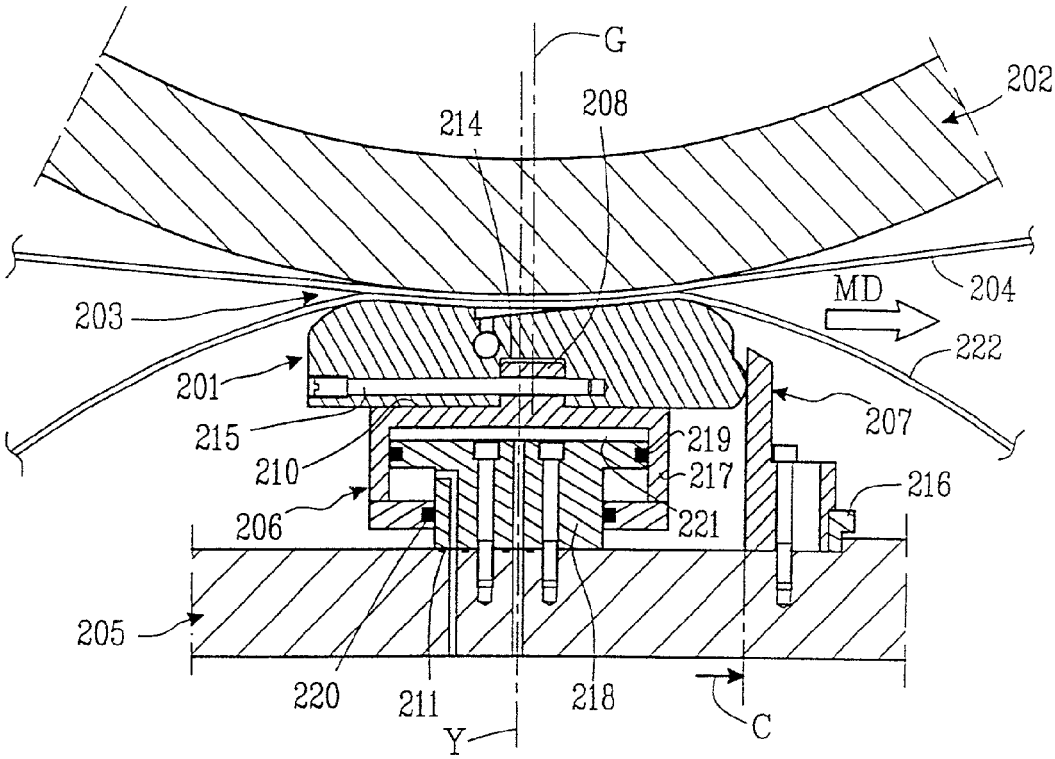
FIG. 2*a* shows a schematic sectional view seen across the machine direction of a shoe press device according to a specially preferred embodiment of the invention, with its press shoe in a first position.
Figure 2B:
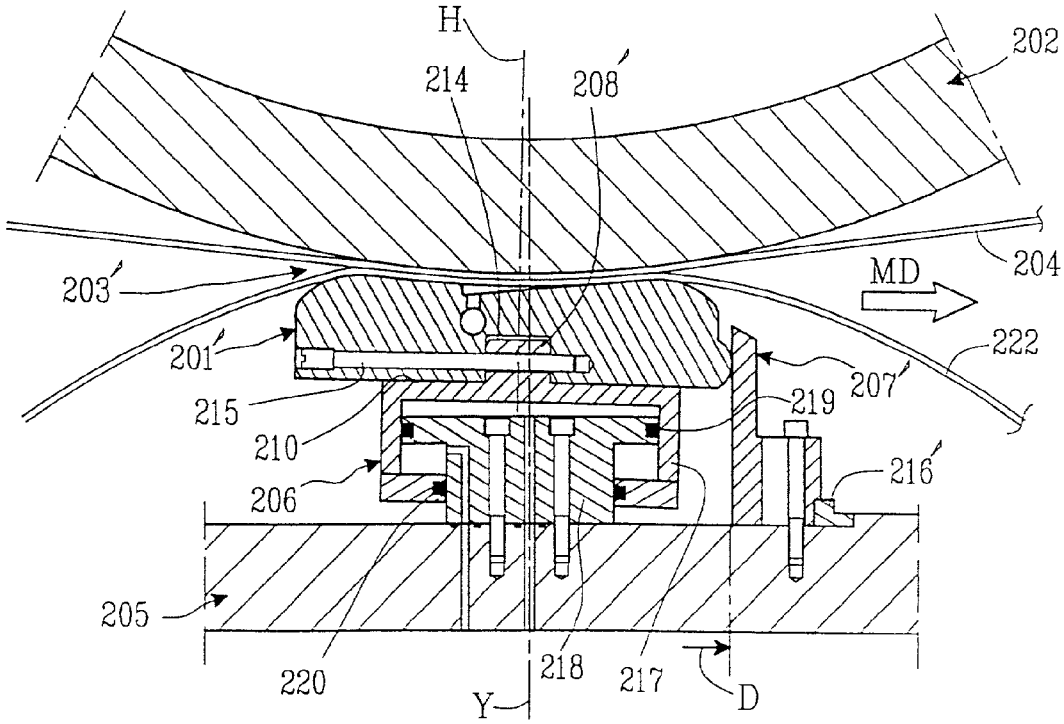
FIG. 2*b* shows a schematic sectional view seen across the machine direction of the shoe press device according to FIG. 2*a*, but this time with its press shoe in a second position.

In the attached FIGS. 2*a* and 2*b* is shown a schematic sectional view of a shoe press device according to a specially preferred embodiment of the invention, in FIG. 2*a* with its press shoe 201 in a first position, and in FIG. 2*b* with its press shoe in a second position.

A press shoe 101; 201 in the first position (FIGS. 1*a* and 2*a*) will generate a predominantly "symmetrical" pressure curve in the machine direction by way of the extended press nip whereby the pressure rises from a low initial value to a pressure maximum and subsequently drops again.

A press shoe 101'; 201' in the second position (FIGS. 1*b* and 2*b*), on the other hand, will generate a pressure curve with a low pressure in the beginning of the press nip that increases towards the end of the press nip, i.e. a pressure curve with its maximum pressure displaced towards the end of the press nip, compared with the case when the press shoe 101; 201 is in the first position (FIGS. 1*a* and 2*a*). One might, of course, contemplate a number of different positions for the press shoe of the shoe press device according to the invention.

The shoe press device according to the invention is intended for pressing of a continuous paper or paperboard web and comprises a press shoe 101, 101'; 201, 201' aligned across the machine direction MD, which press shoe is arranged to form an extended press nip 103, 103'; 203, 203', together with a backing member 102; 202, for the passage of the web 104; 204 during pressing.

The press device according to the invention further comprises a support 105; 205 that supports the press shoe in a manner mobile towards the backing member by way of several loading cylinders 106; 206, arranged along the press shoe in order to make possible the application of pressure to the web during pressing.

At least some of the loading cylinders 106; 206 comprise a first end 110; 210, intended to be fixed to the press shoe 101;101'; 201, 201', and a second end 111; 211, intended to be fixed to the support 105, 205. Thus, an embodiment in which some of the cylinders are not fixed to the press shoe and/or the support, but rather are retained in or controlled in their intended positions in some other appropriate way, is conceivable within the scope of the invention.

Each of the loading cylinders 106; 206 possess a main axis X; Y in their longitudinal direction. By main axis is thereby understood an axis extending predominantly in the direction of extension of a loading cylinder.

As evident from the above, the press shoe of the press device according to the invention is arranged for displacement between different positions 101, 101'; 201, 201' with respect to the support and the backing member for controlling a pressure curve in the machine direction MD throughout the press nip 103, 103'; 203, 203'.

A stop member 107, 107'; 207, 207' is arranged downstream of the press shoe of the pressing device according to the invention. Different types of stop members for restricting the mobility of the shoe in the machine direction, and also in the direction opposite to the machine direction, are already known through the prior art documents discussed above.

The stop member 107, 107'; 207, 207' of the press device according to the invention is arranged for displacement between, and fixing in different stop positions A, B; C, D in the machine direction MD. Thus, in the embodiments shown in FIGS. 1*a*–1*b* and 2*a*–2*b* the stop member can be brought to, and fixed in, two different defined stop positions. One might also contemplate embodiments within the scope of the invention, with stop members that can be moved to, and fixed in, more than two different defined stop positions.

At least some of the loading cylinders 106; 206 or the support 105; 205 of the press device according to the invention comprise members 108, 109, 108', 109'; 208, 208', arranged eccentrically with regard to one or some of the main axes X; Y, which may be brought in different eccentric positions E, F; G, H with respect to the main axes X; Y. During the pressing the current eccentric position E, F; G, H, and the current stop position A, B; C, D, will control the position of the press shoe 101, 101'; 201, 201', and thereby also the abovementioned pressure curve in the machine direction MD throughout the press nip 103, 103'; 203, 203'.

According to one preferred embodiment of the invention, shown in the FIGS. 1*a* and 1*b*, the eccentrically arranged members are constituted by recesses 108, 109; 108', 109' in the first end 110, intended to receive male members 112, 113 for fixation to the press shoe 101, 101'. In this embodiment the male members 112; 113 are constituted by sliding guides pressed into the recesses 108, 109; 108', 109', and into the corresponding recesses of the press shoe. One might also contemplate advantageous embodiments with recesses in the second end, intended to receive male members for fixation to the support, or recesses in the support, intended to receive male members for fixation to the second end.

In a particularly preferred embodiment of the press device according to the invention, the eccentrically arranged members are constituted by male members 208; 208' of the first end 210, intended to be received in recesses 214 in the press shoe 201; 201' for fixation of said press shoe 201, 201' . One might also contemplate advantageous embodiments with male members at the second end, intended to be received in recesses in the support for fixation to said support, or male members at the support, intended to be received in recesses at the second end for fixation to the second end.

The male members mentioned above, may thus be constituted by separately penetrable parts 112, 113, or by protrusions 208, 208' which are integrated into the press shoe, the first end 210, the second end, or into the support.

In the particularly preferred embodiment the fixation of the first and/or second ends comprises that the male members mentioned above provide a recess or a cavity for reception of a dowel 215, a locking pin, or a similar member extending through a passage formed in the press shoe 201, the first end, the second end, or in the support. Thus, in the particularly preferred embodiment as shown in FIGS. 2*a* and 2*b*, a locking pin 215 extends through a passage in the press shoe 201.

In a particularly advantageous embodiment of the press device according to the invention, the stop member 107, 107'; 207, 207' is fixed in the present stop position A, B; C, D, at least by a spacer element 116, 116'; 216, 216' in a recess in the support, abutting the stop member. The spacer element has a geometric design, which in a first position 116; 216 enables said abutment in a first A; C stop position, and which in a second position 116'; 216' enables said abutment in a second B; D stop position in the machine direction MD. Of course, one might also contemplate embodiments within the scope of the invention, in which the spacer element (or the spacer elements) allows abutting contact with the stop member in more than two stop positions.

In the embodiments shown in FIG. 1*a*–2*b* the spacer element consists of a ledge running across the whole width of the stop member across the machine direction, and which may be rotated around its longitudinal axis in order to provide the different stop positions. One might also contemplate embodiments with a plurality of shorter spacer elements that may be rotated or twisted in order to provide the different stop positions, or less advantageous embodiments with replaceable spacer elements of several different dimensions.

According to one embodiment of the press device, at least some of the loading cylinders 106; 206 comprise at least one cylinder part, coupled in a sliding manner to at least one piston part 118; 218 in a sealed manner by contacting gaskets 119; 219,220 to form at least one work chamber 121; 221, inside which the pressure of a pressurising medium may be reduced in order to generate a shortening, or increased in order to generate an extension of the loading cylinder 106; 206. In this embodiment the cylinder part 117; 217 provides the first end 110; 210.

In an alternative embodiment (not shown) the piston part instead consists of a cylindrical coupling part, which in a sliding and sealed manner connects the first cylinder part to a second cylinder part. Thus, in this embodiment at least some of the loading cylinders have three parts sliding with respect to each other, whereby the coupling part advantageously is a substantially cylindrical sleeve, the inner part of which constitutes part of the work chamber.

It is, on the other hand, possible to conceive embodiments of the press device according to the invention, in which the piston part (FIG. 1*a*–2*b*) or the coupling part is a massive, substantially cylindrical body 118; 218, at one or both ends of which is formed a work chamber 121; 221, and, in the case of several work chambers, in which the cylindrical body comprises one or more channels between the two ends for pressure connection between the work chambers.

In yet another alternative embodiment of the press device according to the invention, the first and second cylinders are solid, substantially cylindrical bodies, in which one end is surrounded by the coupling part in order to form the work chamber.

The backing member 102; 202 of the press device according to the invention is preferably a rotating counter roll, and a flexible belt 122; 222, preferably in the form of a sleeve, is arranged in an endless loop to run between the press shoe 101, 101'; 201, 201' and the paper or paperboard web 104, 204 during the pressing.

At the pressing, the paper or paperboard web 104; 204 passing through the press nip 103, 103'; 203, 203' is preferably supported by one or more water-receiving fabrics. Such fabrics, for example press felts, are well known in the art.

The press device according to the invention is particularly advantageously utilised for wet pressing or calendering of a paper or paperboard web.

In the following, a procedure according to the invention, for controlling the pressure curve in the machine direction MD through an extended press nip in a press device will be described, when appropriate with reference to the attached FIGS. 1*a*–2*b*.

The press nip 103, 103'; 203, 203' is thus provided by a device according to the invention, comprising a press shoe 101, 101'; 201, 201', a backing member 102; 202, a support 105, 205, and a number of loading cylinders 106, 206.

At least some of the loading cylinders comprise a first end 110; 210, intended for fixation to the press shoe 101, 101'; 201, 201', and a second end 111; 211, intended for fixation to the support 105; 205, whereby each of the loading cylinders 106; 206 has a main axis X; Y in its longitudinal direction. One may thus contemplate embodiments of the invention, where not all of the loading cylinders are fixed to the press shoe and/or the support.

The press shoe may be moved between different positions 101, 101'; 201, 201' in relation to the support and the backing member for controlling the abovementioned pressure curve, whereby a stop member 107,107'; 207, 207' is provided downstream of the press shoe, and thus limits the mobility of the press shoe in the machine direction.

In the procedure according to the invention the pressure curve is controlled in the machine direction MD through the extended press nip 103; 203 by members 108, 109; 208, eccentrically arranged with respect to one or more of the main axes X; Y, at the support or the loading cylinders 106; 206 being moved from a first eccentric position E; G to a second eccentric position F; H with respect to the main axes, while the stop member 116; 216 is displaced from a first stop position A; C to a second stop position B; D. The second eccentric position F; H and the second stop position B; D will control the position of the press shoe from a first position 101; 201 to a second position 101'; 201' with respect to the support 105; 205 and the backing member 102; 202. As evident from the above, this will change the pressure curve in the machine direction through the extended press nip.

In a preferred embodiment of the procedure according to the invention, the eccentric members are provided in the form of recesses 108, 109; 108', 109' in the first end 110, receiving male members 112; 113 in such a way that the first end is fixed to the press shoe 101; 101'. One may also contemplate embodiments of the procedure according to the invention (not shown) with eccentrically arranged members in the form of recesses in the second end, which receive male members in such a way that the support is fixed to the second end.

In a particularly preferred embodiment of the procedure according to the invention, the eccentrically arranged members are provided in the form of male members 208; 208' of the first end 210, received in recesses 214 in the press shoe 201; 201' in such a way that the first end is fixed to the press shoe. One may also contemplate embodiments in the shape of male members of the second end, received by recesses in the support in such a way that the second end is fixed to the support, or in the shape of male members of the support that are received by recesses in the second end in such a way that the support is fixed to the second end.

In the particularly preferred embodiment of the procedure according to the invention, a recess or a cavity is advantageously provided in said male members 208; 208', and a passage is provided in the press shoe 201, in the first end or the second end, whereby a locking pin 215, a peg, a locking screw, or a similar member is introduced into the recess or the cavity by way of the passage in order to fix the first and/or second ends.

In a particularly advantageous embodiment of the procedure according to the invention the stop member 107, 107'; 207, 207' is fixed in the present stop position A, B; C, D, at least by a spacer element 116, 116'; 216,216' in a recess of the support, abutting the stop member. In this embodiment the spacer element is initially brought into a first position 116; 216 in order to provide the abutment in a first stop position A;C, and is thereafter brought into a second position 116'; 216' in order to provide the abutment in a second stop position B; D in the machine direction.

In another advantageous embodiment of the procedure according to the invention, a first number of the abovementioned plurality of loading cylinders 206 are double-acting, while a second number of said plurality of loading cylinders are single-acting. By double-acting is herein understood a loading cylinder with the capability of generating force in its extending direction as well as in its shortening direction, while single-acting designates a loading cylinder with the capability of generating force only in its extending direction. In this embodiment the fixation is performed by said male members 208; 208' only at the first number of loading cylinders 206, whereby the first number is smaller than the second number, and particularly advantageously less than a third of the second number. This embodiment considerably shortens the switching time between different pressure curves, because the eccentrically arranged members of the non-fixated loading cylinders may be rapidly rotated or displaced to a desired location, without any particular disengaging from the press shoe, when the non-fixated loading cylinders are in a pressure-less condition and do not contact the press shoe.

In the case when the shoe press device according to the invention comprises both double-acting (possessing both extension and shortening power) and single-acting (possessing extending power only) loading cylinders 106; 206, the double-acting loading cylinders 206 are advantageously of the type that is shown in the FIGS. 2*a* and 2*b*, while the single-acting loading cylinders 106 advantageously are of the type shown in the FIGS. 1*a* and 1*b*. It is possible, though, to contemplate embodiments within the scope of the invention, in which both double-acting and single-acting loading cylinders are of the same type, or in which the loading cylinders are of some other suitable type within the scope of the appended patent claims.

The present invention shall in no way be construed as being limited to what has been described herein in connection with the different embodiments, or what has been shown in the attached figures. Rather, the scope of the invention is defined by the appended patent claims.

The mechanic and hydraulic, alternatively pneumatic, components being part of the shoe press device according to the invention have not been described in detail herein, since such components should be well known to those skilled in the art, and furthermore have been described and illustrated in above mentioned EP 0 933 471.

What is claimed is:

1. A press device for pressing a web that is carried in a machine direction through an extended nip between the press device and a backing member, comprising:

a press shoe adapted to be juxtaposed with the backing member to form said extended nip through which the web passes, the press shoe extending in a cross-machine direction along substantially a full width of the web and being arranged to be moved between different positions with respect to the backing member for controlling a pressure curve in a machine direction through the nip;

a support that supports the press shoe such that the press shoe is movable in a loading direction toward the backing member for applying pressure to the web;

a plurality of extendable and retractable loading cylinders spaced apart in the cross-machine direction along the press shoe, each loading cylinder having a main axis in a longitudinal direction along which the loading cylinder extends and retracts, each loading cylinder comprising a first end fixed on the press shoe and a second end fixed on the support; and a stop member arranged downstream of the press shoe, the stop member being arranged to be moved between and fixed in different stop positions in the machine direction, wherein the stop member is fixed in a selected stop position at least by a spacer element disposed in a recess in the support which spacer element abuts the stop member, wherein the spacer element is of a geometric design which in a first position abuts the stop member in a first stop position and in a second position abuts the stop member in a second stop position in the machine direction, and wherein at least some of the loading cylinders or the support comprise members eccentrically arranged with respect to one or some of the main axes which members can be brought into different eccentric positions with respect to said main axes in such a way that the eccentric position and stop position control said position of the press shoe during pressing and thereby control said pressure curve in the machine direction through the press nip.

2. A press device according to claim 1, wherein the eccentrically arranged members comprise recesses in the first end of the loading cylinder for receiving male members fixed to the press shoe, recesses in the second end of the loading cylinder for receiving male members fixed to the support, or recesses in the support for receiving male members fixed to the second end.

3. A press device according to claim 1, wherein the eccentrically arranged members comprise male members fixed to the first end of the loading cylinder for being received in recesses in the press shoe, male members fixed to the second end of the loading cylinder for being received in recesses in the support, or male members fixed to the support for being received in recesses in the second end.

4. A press device according to claim 3, wherein said male members include a recess or a cavity for receiving a locking pin, a peg, a locking screw, or a similar member running through a passage provided in the member having said recesses for receiving said male members.

5. A press device according to claim 1, in which at least some of the loading cylinders comprise at least one cylinder part coupled in a sliding fashion to at least one piston part in a sealed manner by contacting sealing members forming at least one work chamber inside which pressure of a pressurising medium can be reduced in order to generate a shortening or increased in order to generate an extension of the loading cylinder, and wherein the cylinder part forms the first end of the loading cylinder.

6. A method for controlling a pressure curve in a machine direction through an extended press nip, which press nip is provided by a press device comprising a press shoe, a backing member that forms said press nip with the press shoe, a support on which the press shoe is movably supported, and a plurality of loading cylinders arranged between the support and the press shoe at least some of which comprise a first end fixed to the press shoe and a second end fixed to the support, and each of the loading cylinders having a main axis in a longitudinal direction along which the loading cylinder is extended and retracted, and in which the press shoe can be moved in the machine direction to different positions with respect to the support and the backing member in order to control the pressure curve, the method comprising:

providing a stop member downstream of the press shoe, and displacing the stop member from a first stop position to a second stop position in the machine direction, wherein the stop member is fixed in a selected stop position at least by use of a spacer element disposed in a recess of the support which element abuts the stop, and wherein the spacer element is brought into a first position in order to abut the stop member in said first stop position, and the spacer element subsequently is brought into a second position in order to abut the stop member in said second stop position in the machine direction; and providing members engaged between the support and at least some of the loading cylinders, or between at least some of the loading cylinders and the press shoe, which control a position of the press shoe, said members being eccentrically arranged with respect to one or more of the main axes, and displacing said members from a first eccentric position to a second eccentric position with respect to said main axes, whereby the second eccentric position and the second stop position control the position of the press shoe from a first position to a second position with respect to the support and the backing member.

7. The method according to claim 6, wherein the eccentrically arranged members are provided in the form of recesses in one of the press shoe and the support which receive male members on the loading cylinders for fixing the loading cylinders relative to said one of the press shoe and support.

8. The method according to claim 7, wherein a cavity is provided in each of said male members, and a passage is provided in said one of the press shoe and support for receiving one of a locking pin, a peg, and a locking screw, which is received into said cavity in order to fix the loading cylinders relative to said one of the press shoe and support.

9. The method according to claim 6, wherein the eccentrically arranged members are provided in the form of male members on one of the press shoe and the support which are received into recesses on the loading cylinders for fixing the loading cylinders relative to said one of the press shoe and support.

10. The method according to claim 7, in which a first number of said plurality of loading cylinders comprise double-action cylinders and a second number of said plurality of loading cylinders comprise single-action cylinders, and wherein fixing of loading cylinders by way of said male members is performed only at the first number of loading cylinders, and the first number is smaller than the second number.

11. The method according to claim 8, in which a first number of said plurality of loading cylinders comprise double-action cylinders and a second number of said plurality of loading cylinders comprise single-action cylinders, and wherein fixing of loading cylinders by way of said male members is performed only at the first number of loading cylinders, and the first number is smaller than the second number.

12. The method according to claim 10, wherein the first number is smaller than one-third of the sum of the first and second numbers.

13. The method according to claim 11, wherein the first number is smaller than one-third of the sum of the first and second numbers.

* * * * *